US005501364A

United States Patent [19]

Cooper

[11] Patent Number: 5,501,364

[45] Date of Patent: Mar. 26, 1996

[54] DOORSTOPS FOR MULTIPLE-PRODUCT MERCHANDISING MACHINE

[75] Inventor: Alan Cooper, Lancashire, England

[73] Assignee: Unidynamics Corporation, Stamford, Conn.

[21] Appl. No.: 311,595

[22] Filed: Sep. 23, 1994

[51] Int. Cl.[6] ..... G07F 11/54

[52] U.S. Cl. ..... 221/12; 221/120; 221/304; 49/450

[58] Field of Search ..... 22/12, 154, 119, 22/120, 304; 312/35, 97.1, 301; 49/449, 450

[56] References Cited

U.S. PATENT DOCUMENTS

| | | | |
|---|---|---|---|
| 4,317,604 | 3/1982 | Krakauer | 312/97.1 |
| 4,643,107 | 2/1987 | Gunn et al. | 312/305 X |
| 4,927,051 | 5/1990 | Falk et al. | 221/12 |

*Primary Examiner*—William E. Terrell
*Assistant Examiner*—Dean A. Reichard
*Attorney, Agent, or Firm*—Senniger, Powers, Leavitt & Roedel

[57] ABSTRACT

A variable doorstop selectively determines the opening distance of an access door of a merchandising machine, the access door being mounted in channels of the merchandising machine to be slidable between an open position wherein the access door permits access to a compartment aligned therewith and a closed position wherein access to the compartment is restricted. The doorstop comprises a hinge assembly including at least one hinge. Each hinge has a backing plate for mounting the hinge on the merchandising machine and at least one abutment plate. The at least one abutment plate is rotatable about a pin of the hinge to selectively pivot the abutment plate from a non-engagement position in which the abutment plate is positioned away from the path of the access door to an engagement position in which the abutment plate is in the path of the access door. The abutment plate in the engagement position establishes the open position by restricting the access door from sliding further along the channels past the abutment plate in the engagement position as the access door is slid from the closed position to the open position.

16 Claims, 2 Drawing Sheets

DOORSTOPS FOR MULTIPLE-PRODUCT MERCHANDISING MACHINE

BACKGROUND OF THE INVENTION

The present invention relates to multiple-product merchandising machines and more particularly to variable doorstops for selectively determining the opening distance of an access door for such merchandising machines.

Multiple-product merchandising machines dispense many different kinds and sizes of products. For this purpose, the merchandising machines have compartments of different or variable widths to accommodate the different sized products thereby maximizing the amount of product offered by the machine. Such a machine is illustrated and described, for example, in U.S. Pat. No. 4,927,051, assigned to the assignee of the present invention. Provision must be made for limiting the width which an access door of the merchandising machine can be opened so that it corresponds to the width of the compartment. If the access door could be opened beyond the width of the compartment, merchandise from adjacent compartments could be removed. It is usual to set all partitions on a given shelf of the merchandising machine for the same width of compartment since they must all be accessed by the same door.

In prior multiple-product merchandising machine designs, such as that disclosed in the aforementioned patent, a stop member is securely fixed at a location along a strip mounted on the inside of the service door to limit the opening distance of the access door. The access door is stopped in its opening movement by coming into engagement with the edge of the stop member as the door is slid from its closed position to its open position. Threaded holes are preselected along the strip to determine several locations for the stop member and thus define several opening distances for the access door corresponding to several standard size compartment widths. The stop member is fastened to the strip by bolting the member to the strip. In order to adjust the opening distance of the access door, the stop member is unscrewed from the strip and refastened at another position on the strip. Although generally satisfactory, the procedure to adjust the opening width of the access door is time-consuming and requires the serviceman to carry tools along when reloading the merchandising machine.

SUMMARY OF THE INVENTION

Among the several objects and features of the present invention may be noted the provision of a variable doorstop which selectively adjusts the opening distance of the access door of the merchandising machine; the provision of such a doorstop which defines several opening distances for the access door; the provision of such a doorstop which quickly and easily adjusts the opening distance of the access door; the provision of such a doorstop which is easily mounted on the merchandising machine; and the provision of such a doorstop which is inexpensive to manufacture.

Generally, a doorstop of this invention selectively determines the opening distance of the access door of the merchandising machine. The access door is mounted in channels of the merchandising machine to be slidable between an open position wherein the access door permits access to a compartment aligned therewith and a closed position wherein access to the compartment is restricted. The doorstop comprises a hinge assembly including at least one hinge. Each hinge has a backing plate for mounting the hinge on the merchandising machine and at least one abutment plate rotatable about a pin of the hinge to selectively pivot the abutment plate from a non-engagement position in which the abutment plate is positioned away from the path of the access door to an engagement position in which the abutment plate is in the path of the access door. The doorstop thereby establishes the opening distance of the access door in the open position by restricting the access door from sliding further along the channels past the abutment plate in the engagement position as the access door is slid from the closed position to the open position.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
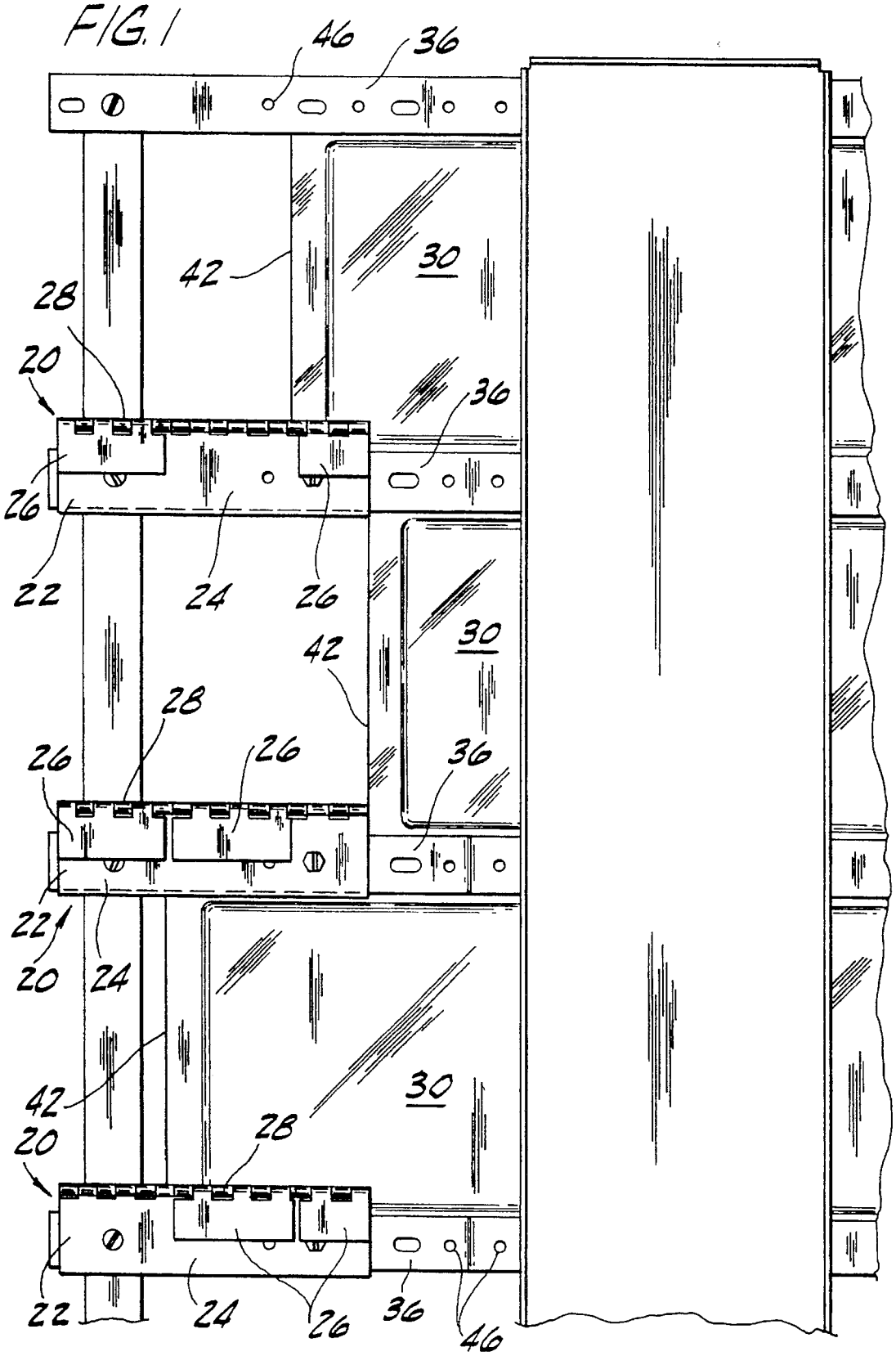
FIG. 1 is a partial rear view of product access doors of a merchandising machine with doorstops of the present invention defining different opening distances for each access door.

Referring now to the drawings, a variable doorstop of the present invention for selectively determining the opening distance for an access door of a merchandising machine is indicated generally at 20. The doorstop 20 of the present invention comprises a hinge assembly including at least one hinge, each indicated at 22. Each hinge 22 includes a backing plate 24 and a plurality of abutment plates, each indicated at 26, rotatable about a pin 28 of the hinge.

Figure 2:
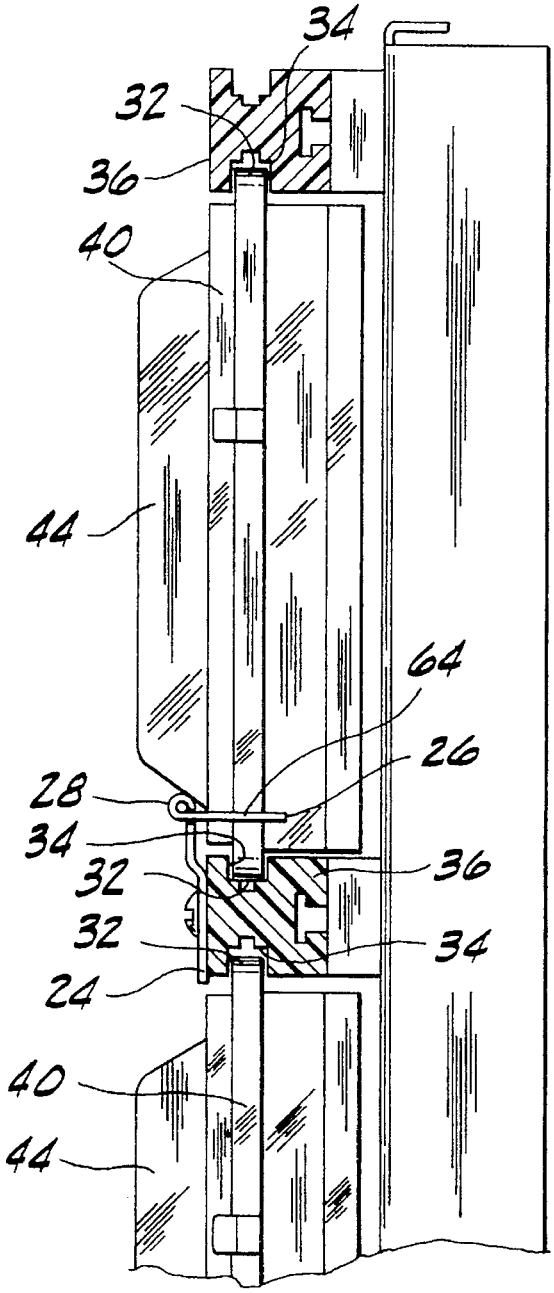
FIG. 2 is a partial sectional side view of the product access doors, looking from the left of FIG. 1.
Figure 4:
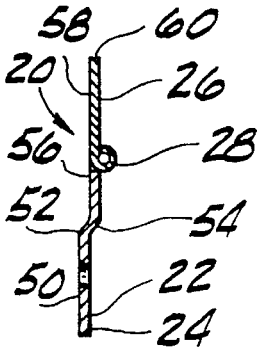
FIG. 4 is a side elevational view of the doorstop taken along line 4—4 of FIG. 3.
Figure 3:
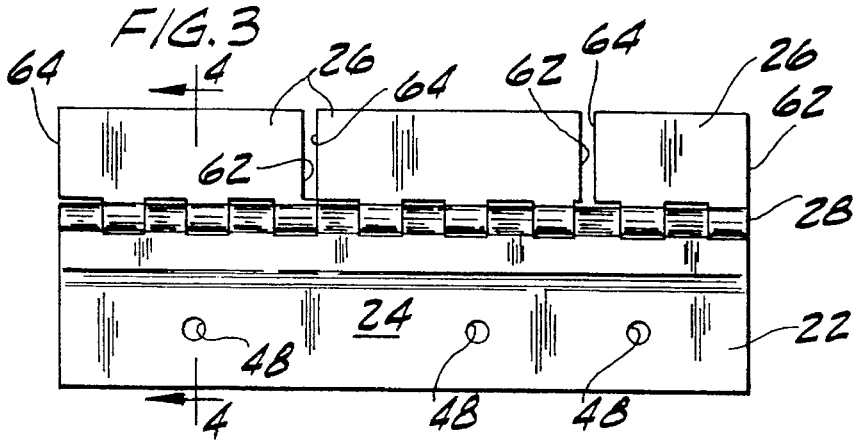
FIG. 3 is a front view of the doorstop of the present invention with its abutment plates extending upwardly for clarification purposes.

Typically, a multiple-product merchandising machine, such as that disclosed in aforementioned U.S. Pat. No. 4,927,051 incorporated herein by reference thereto, includes a plurality of transparent access doors 30 mounted in a front service door which forms most of the front of the cabinet of the machine. The access doors 30 are in a common vertical plane and, as seen in FIG. 2, each access door is slidably mounted with its top and bottom edges, each indicated at 32, in respective channels 34 which are formed in upper and lower horizontal bars, each indicated at 36, corresponding to each access door. The horizontal bars 36 are secured to the front face of the service door. Each access door 30 has a front edge 40 and a rear edge 42 and is mounted for horizontal sliding movement between a closed, normally locked position wherein the front edge of the door engages a vertical bar (not shown) of the merchandising machine thereby restricting access to the compartment and an open position in which the front edge of the door is spaced from the vertical bar of the merchandising machine enabling access to a compartment aligned with the access door in the interior of the cabinet. A handle 44, also transparent, is mounted to or formed in each access door 30 to permit the doors to be manually moved between the open and closed positions.

One doorstop 20 is provided for each access door 30 and preferably comprises one butt hinge 22 having a single backing plate 24 and a plurality of abutment plates 26. The doorstop 20 is preferably made of steel. It is to be understood that different types of hinges and different materials—such as plastic—may be used for the doorstop 20 without departing from the scope of the present invention. Each doorstop 20 is preferably mounted on the lower horizontal bar 36 corresponding to a particular access door 30. Threaded holes 46 are positioned along the horizontal bar 36 to enable the doorstop 20 to be mounted thereon. The backing plate 24 of the doorstop 20 is provided with holes 48 to enable the hinge 22 to be secured to the horizontal bar 36 by bolting the backing plate 24 to the bar. It is to be understood that other fastening arrangements may be used without departing from the scope of the present invention.

The backing plate 24 is an elongate relatively thin rigid member. The backing plate 24 includes a bottom, generally flat panel 50 which is mounted to the horizontal bar 36 of the merchandising machine and lies generally flat against the respective side of the horizontal bar. The bottom panel 50 has an upper edge 52. An intermediate generally flat transition panel 54 extends upwardly and outwardly from the upper edge 52 of the bottom panel 50 away from the horizontal bar 36. The transition panel 54 has an upper edge 56 which is spaced from the horizontal bar 36 as the backing plate 24 is mounted on the frame member. The backing plate 24 further includes an upper generally flat panel 58 extending upwardly from the upper edge 56 of the intermediate transition panel 54 as the backing plate is applied to the horizontal bar 36. The pin 28 of the hinge 22 is mounted on an upper edge 56 of the transition panel 54 of the backing plate 24 to space the pin from the horizontal bar 36 as the backing plate is mounted on the frame member to permit the abutment plates 26 to pivot freely about the hinge.

The plurality of abutment plates 26 of the hinge 22 define the opening distance for the access door 30 in the open position. Each abutment plate 26 is independently rotatable about the pin 28 of the hinge 22 to selectively pivot one of the abutment plates from a non-engagement position in which the abutment plate is positioned away from the path of the access door 30 to an engagement position in which the abutment plate is in the path of the access door. As shown in FIG. 1, in the non-engagement position, the respective abutment plate 26 preferably extends substantially vertically downwardly from the pin 28 of the hinge 22 to contact the backing plate 24 of the hinge. In the engagement position, the abutment plate 26 preferably extends substantially horizontally away from the pin 28 into the path of the access door 30. Each abutment plate 26 has a leading edge 62 and a trailing edge 64 and the access door 30 is stopped in its opening movement by having its rear edge 42 come into engagement with the leading edge 62 of the abutment plate of the doorstop 20 as the door 30 is slid in the channels 34 from its closed position to its open position.

In the preferred embodiment, the hinge 22 has three abutment plates 26. By independently pivoting each abutment plate 26 into and out of a respective engagement position, each abutment plate of the doorstop individually establishes a different open position for the access door 30. Thus, the doorstop 20 defines three distinct opening distances for the access door 30 by restricting the access door from sliding further along the channels 34 past the respective abutment plate 26 in engagement position as the access door is slid from the closed position to the open position.

Preferably, the abutment plates 26 are closely spaced apart so that the width of a respective abutment plate determines the opening distance corresponding to the abutment plate adjacent its trailing edge 64. For this purpose and depending on the required opening distances for a respective compartment, each abutment plate 26 of the hinge 22 may have a different width than the other abutment plates to define specific opening distances. It is to be understood that any number of abutment plates and differently sized and shaped abutment plates may be used without departing from the scope of the present invention.

It is to be understood that the hinge assembly 22 of the doorstop 20 may have any number of hinges 24 defining any number of opening distances for the access door 30 without departing from the scope of the present invention. In a multi-hinge embodiment, the hinges 22 are separated as mounted on the horizontal bar 36. Each hinge 22 has a backing plate 24 and preferably a plurality of abutment plates 26.

In operation, doorstops 20 are mounted on the merchandising machine by bolting the backing plate 24 of each doorstop to the horizontal bar 36 corresponding to the access door 30 such that each access door has a corresponding doorstop. The opening distance is set for each access door 30 by independently pivoting each abutment plate 26 into and out of a respective engagement position to establish a desired open position for the access door. Since pivoting a particular abutment plate 26 into an engagement position determines the distance a particular access door 30 can be opened, it is necessary to set all of the compartments on a given shelf of a drum of a merchandising machine for a given width since they must all be accessed by the same door.

If the compartment width of the shelf of the merchandise machine is changed to accommodate a different product, the opening distance for the access door can be easily adjusted by independently pivoting each abutment plate 26 into and out of a respective engagement position to establish the new desired opening distance for the access door.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A variable doorstop for selectively determining the opening distance of an access door of a merchandising machine, said access door being mounted in channels of the merchandising machine to be slidable along a path between an open position wherein the access door permits access to a compartment aligned therewith and a closed position wherein access to the compartment is restricted, the doorstop comprising a hinge assembly including at least one hinge, each hinge having a backing plate for mounting the hinge on the merchandising machine and at least one abutment plate rotatable about a pin of the hinge to selectively pivot the abutment plate from a non-engagement position in which the abutment plate is positioned away from the path of the access door to an engagement position in which the abutment plate is in the path of the access door thereby establishing the open position by restricting the access door from sliding further along the channels past the abutment plate in the engagement position as the access door is slid from the closed position to the open position.

2. A variable doorstop as set forth in claim 1 wherein the at least one hinge has a plurality of abutment plates, each abutment plate being independently and selectively rotatable about the pin of the hinge into and out of respective engagement positions to individually establish different open positions for the door.

3. A variable doorstop as set forth in claim 2 wherein the abutment plates of the hinge have different widths.

4. A variable doorstop as set forth in claim 1 wherein each abutment plate has a leading edge and a trailing edge and the access door has a leading edge and a trailing edge, the leading edge of the abutment plate engaging the trailing edge of the access door to stop the opening movement of the access door as the access door is slid from the closed position to the open position when the at least one abutment plate is in its engagement position.

5. A variable doorstop as set forth in claim 1 wherein the abutment plate in the non-engagement position contacts the backing plate.

6. A variable doorstop as set forth in claim 5 wherein the abutment plate in the non-engagement position extends substantially vertically downwardly from the pin of the hinge.

7. A variable doorstop as set forth in claim 6 wherein the abutment plate in the engagement position extends substantially horizontally away from the pin into the path of the access door thereby restricting the access door from sliding past the abutment plate in the engagement position as the access door is slid from the closed position to the open position.

8. A variable doorstop as set forth in claim 1 wherein the backing plate is an elongate relatively thin rigid member which as applied to a frame member of the merchandising machine lies generally flat against the respective side of the frame member, said backing plate having a bottom, generally flat panel having an upper edge, an intermediate generally flat transition panel angled upwardly and outwardly from the upper edge of the bottom panel away from the frame member, said transition panel having an upper edge which is spaced from the frame member as the backing plate is mounted on the frame member, and an upper generally flat panel extending upwardly from the upper edge of the intermediate transition panel as the backing plate is applied to the frame member, the pin of the hinge being mounted on an upper edge of the transition panel of the backing plate to space the pin from the frame member as the backing plate is mounted on the frame member.

9. A variable doorstop for selectively determining the opening distance of an access door of a multi-product merchandising machine having compartments of different widths, said access door being mounted in channels of the merchandising machine to be slidable along a path between an open position wherein the access door permits access to a compartment aligned therewith and a closed position wherein access to the compartment is restricted, the doorstop comprising a hinge having a backing plate for mounting the hinge on the merchandising machine and at least one abutment plate rotatable about a pin of the hinge to selectively pivot the abutment plate from a non-engagement position in which the abutment plate is positioned away from the path of the access door to an engagement position in which the abutment plate is in the path of the access door thereby establishing the open position by restricting the access door from sliding further along the channels past the abutment plate in the engagement position as the access door is slid from the closed position to the open position.

10. A variable doorstop as set forth in claim 9 wherein the hinge has a plurality of abutment plates, each abutment plate selectively rotatable about the pin of the hinge into and out of respective engagement positions to determine the opening distance of the access door.

11. A variable doorstop as set forth in claim 10 wherein the hinge has three abutment plates, each abutment plate selectively rotatable about the pin of the hinge into its respective engagement position to define three distinct opening distances for the access door.

12. A variable doorstop as set forth in claim 11 wherein the abutment plates of the hinge have different widths.

13. A variable doorstop as set forth in claim 9 wherein each abutment plate has a leading edge and a trailing edge and the access door has a leading edge and a trailing edge, the leading edge of each abutment plate engaging the trailing edge of the access door to stop the opening movement of the access door as the access door is slid from the closed position to the open position when the at least one abutment plate is in its engagement position.

14. A variable doorstop as set forth in claim 9 wherein each abutment plate in the non-engagement position contacts the backing plate.

15. A variable doorstop as set forth in claim 14 wherein each abutment plate in the non-engagement position extends substantially vertically downwardly from the pin of the hinge.

16. A variable doorstop as set forth in claim 15 wherein each abutment plate in the engagement position extends substantially horizontally away from the pin into the path of the access door thereby restricting the access door from sliding past the abutment plate in the engagement position as the access door is slid from the closed position to the open position.

* * * * *